United States Patent [19]

Caffyn et al.

[11] 4,395,958

[45] Aug. 2, 1983

[54] INCINERATION SYSTEM

[75] Inventors: Allan E. Caffyn, South Windsor, Conn.; James L. Lobik, Springfield, Mass.

[73] Assignee: Industronics, Inc., South Windsor, Conn.

[21] Appl. No.: 332,946

[22] Filed: Dec. 21, 1981

[51] Int. Cl.[3] ..... F23G 5/06

[52] U.S. Cl. ..... 110/246; 110/211; 110/216; 110/323; 110/165 R

[58] Field of Search ..... 110/246, 210, 211, 212, 110/238, 216, 323, 165 R, 186

[56] References Cited

U.S. PATENT DOCUMENTS

| | | | |
|---|---|---|---|
| 2,960,943 | 11/1960 | Andersen | 110/246 X |
| 3,173,389 | 3/1965 | Cates, Jr. et al. | 110/246 X |
| 3,823,677 | 7/1974 | Polsak | 110/246 |
| 3,842,762 | 10/1974 | Sargent et al. | 110/246 X |
| 4,188,892 | 2/1980 | Kiefer et al. | 110/238 |
| 4,363,785 | 12/1982 | Willson | 110/211 X |

*Primary Examiner*—Edward G. Favors

*Attorney, Agent, or Firm*—McCormick, Paulding & Huber

[57] ABSTRACT

An incineration system for processing solid, semi-solid waste material and sludge includes an incinerator unit which has a horizontally disposed rotary primary oxidation chamber and a generally vertically disposed secondary oxidation chamber which receives gaseous products of combustion from the primary chamber. Baffles within the secondary chamber provide a tortuous gas flow path through the secondary chamber. Gaseous emissions from the incinerator unit pass through a heat recovery boiler, a baghouse and a scrubber tower before being discharged to atmosphere. A control system controls rotation of the primary oxidation chamber and an auger/shredder which feeds waste material to be burned into the primary oxidation chamber. The control system may include a programmable computer for modifying the control functions in response to programmed data relating to the characteristics of material processed in the incineration system.

49 Claims, 11 Drawing Figures

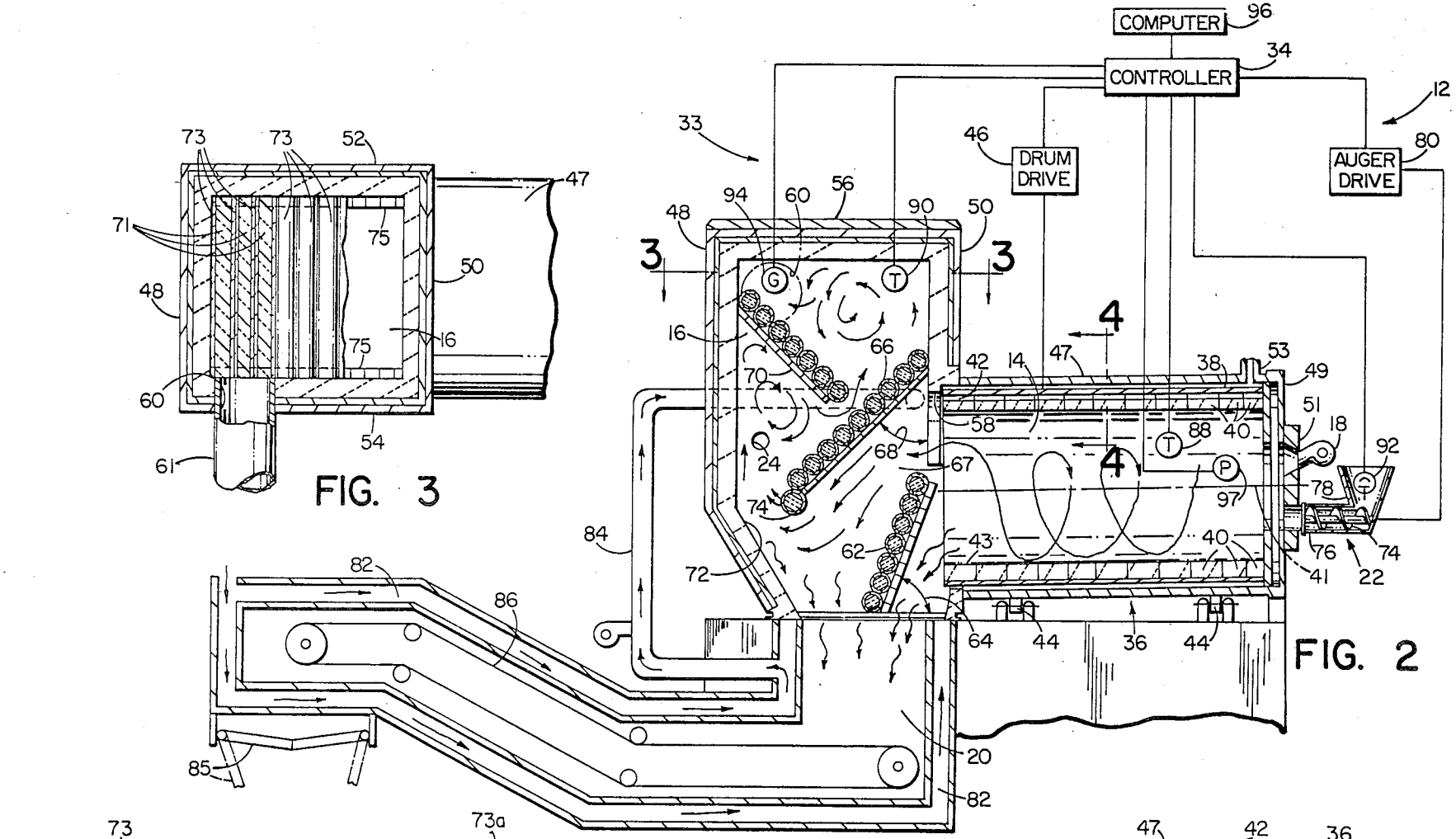
FIG. 2
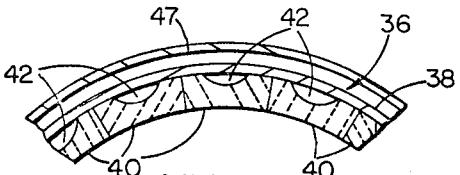
FIG. 4
FIG. 3
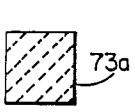
FIG. 10
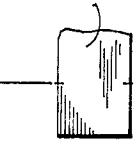
FIG. 9
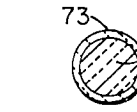
FIG. 8
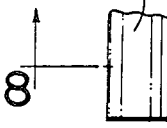
FIG. 7

INCINERATION SYSTEM

BACKGROUND OF THE INVENTION

This invention relates in general to incineration systems and deals more particularly with an improved system of the type which includes a rotary primary oxidation chamber and a secondary oxidation chamber or afterburner which receives gaseous products of combustion from the primary chamber.

Heretofore, incineration systems of the aforedescribed general type have been provided which are capable of burning waste materials including solids, semi-solids, liquids and sludges individually or in combination. However, because of the variable characteristics of the material processed, as, for example, the BTU value per pound, density, moisture content, percentage of inert material and resistance to feeding, such incineration systems have proven most difficult to control. Wide fluctuations in the operational conditions within a system have an adverse effect upon the overall efficiency of the system. Substantial additional heat input from one or more external auxiliary heat sources is often required to maintain uniform operational conditions within such an incineration system to achieve efficient waste incineration while maintaining system emissions within acceptable environmental control standards. Further, maintenance of sufficient retention time in both the primary oxidation chamber and the secondary oxidation chamber of such a system is a major factor in achievement of a high degree of system efficiency.

It is the general aim of the present invention to provide an improved incineration system of the aforedescribed general type of disposing of waste materials including solids, semi-solids, liquids, and sludges, which may be toxic or hazardous. A further aim of the invention is to provide an incineration system which may be controlled to maintain substantially uniform operational characteristics and high efficiency, despite the widely varying characteristics of the waste material processed, and which attains efficient energy recovery while meeting or exceeding accepted environmental control standards.

SUMMARY OF THE INVENTION

In accordance with the present invention an incineration system comprises a rotary drum defining a generally horizontally disposed primary oxidation chamber, and a vertically disposed secondary oxidation chamber, which has an inlet opening in its lower portion and an outlet opening in its upper portion. A discharge opening in one end of the drum communicates with the inlet opening in the secondary chamber. Baffle means disposed within the secondary chamber include a first baffle wall, inclined upwardly and in the direction of the discharge opening for blocking flow of gases and other products of combustion from the lower portion of the primary oxidation chamber into the secondary oxidation chamber. The baffle means further include a second baffle wall inclined downwardly from a position above the discharge opening and in a direction away from the discharge opening. The baffle walls cooperate with walls of the secondary oxidation chamber to define a tortuous flow path for gases of combustion which flow from an upper portion of the primary oxidation chamber into and through the secondary oxidation chamber to the outlet opening.

BRIEF DESCRIPTION OF THE DRAWINGS

FIG. 2 is a somewhat schematic longitudinal sectional view through the incinerator shown in FIG. 1.

FIG. 3 is a fragmentary sectional view taken along the line 3—3 of FIG. 2.

FIG. 4 is a somewhat enlarged fragmentary sectional view taken along the line 4—4 of FIG. 2.

FIG. 7 is a somewhat enlarged fragmentary plan view of a typical baffle wall element.

FIG. 8 is a sectional view taken along the line 8—8 of FIG. 7.

FIG. 9 is similar to FIG. 7 but shows another baffle wall element.

FIG. 10 is a sectional view taken along the line 10—10 of FIG. 9.

DETAILED DESCRIPTION OF PREFERRED EMBODIMENT

Figure 1:
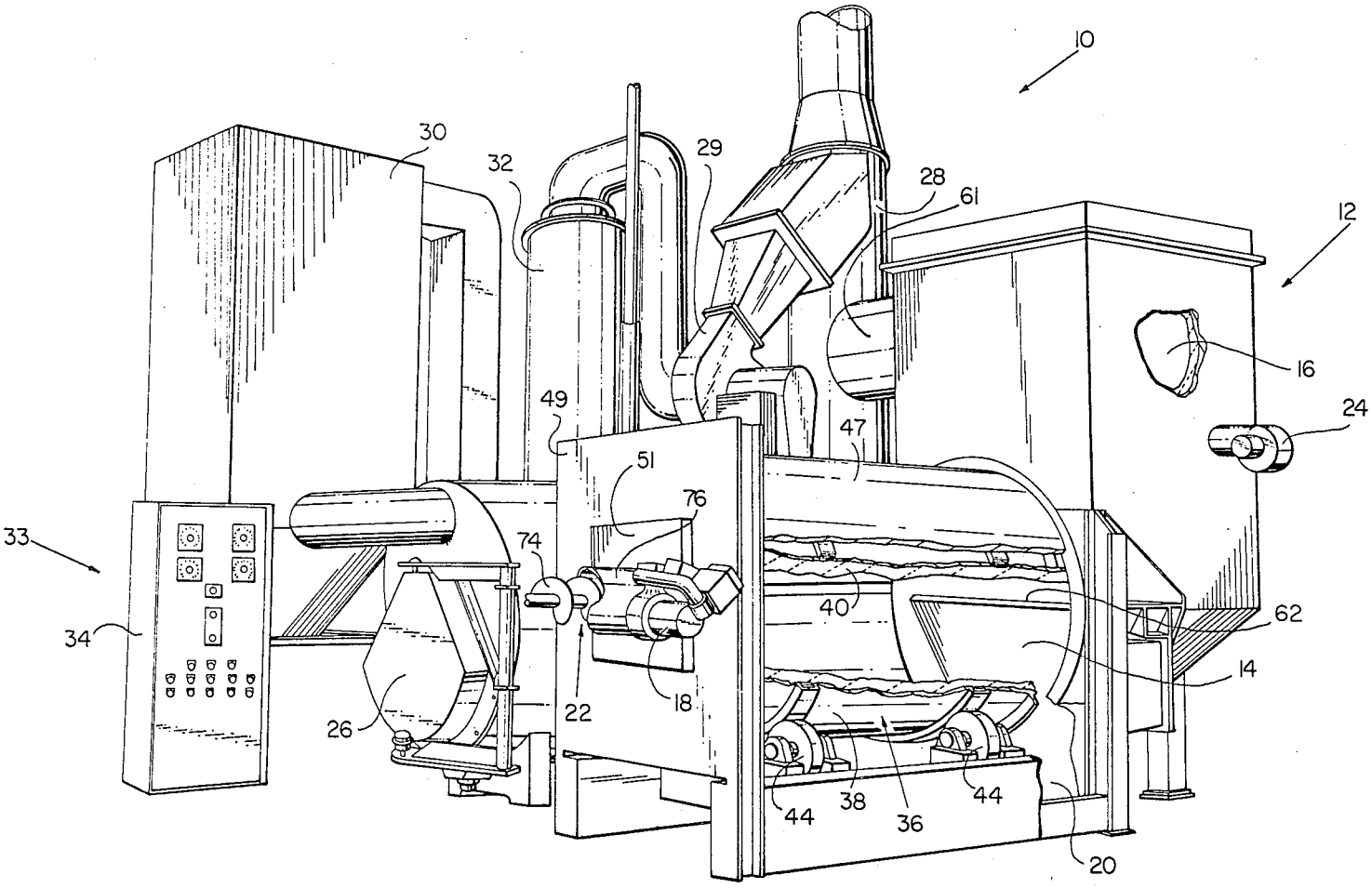
FIG. 1 is a perspective view of an incineration system embodying the present invention.

Turning now to the drawings, and referring particularly to FIG. 1, an incineration system embodying the present invention is indicated generally by the reference numeral 10. The illustrated system 10 generally comprises an incinerator designated generally by the numeral 12, which includes a rotary primary oxidation chamber 14 and a secondary stationary oxidation chamber 16 which receives gaseous products of combustion from the primary oxidation chamber. An ignition burner 18 initiates the incineration process and, depending on the nature of the waste material being burned, may supply additional heat to maintain proper temperatures within the primary oxidation chamber 14. An ash receiver 20, located generally below the secondary oxidation chamber 16, receives ash and other unburned material from both the primary and secondary oxidation chambers.

A suitable feeding apparatus is provided for handling the waste material to be processed. The illustrated apparatus 10 is particularly adapted to burn solid and semi-solid waste and/or sludge and has an auger/shredder feeding apparatus, indicated generally at 22, particularly adapted to shred and compact bulky solid waste as it is fed into the incinerator 12. One or more additional burners, such as the burner 24, may be provided to assure maintenance of predetermined temperatures within the secondary oxidation chamber 16, however, where the waste material to be burned has a low to medium BTU value per pound (1500 BTU dry) the oxidizing process will be self-sustaining. In some circumstances material having an even lower BTU value per pound and relatively high moisture contents can be accommodated and maintained in self-sustaining mode.

In the illustrated system 10, hot gases from the secondary oxidation chamber pass into a heat exchanger, such as the illustrated waste heat boiler 26, through a refractory lined stack 28 which has a built-in bypass to allow passage of hot gases directly up the stack under emergency conditions and while shutting down the feeding apparatus. A strategically located exhaust fan 29 induces a draft to create negative pressure within the system while returning to the atmosphere environmentally safe gases received from a baghouse 30 and a packed tower scrubber 32, which comprise part of the illustrated system 10. However, it should be understood that an incineration system constructed in accordance with the present invention may not require a baghouse, scrubber or other external particulate removal device. A control system indicated generally at 33, which includes a controller 34 and associated instrumentation, is provided for controlling the incineration system 10, as will be hereinafter more fully discussed. Safety interlocks monitor high and low temperatures, waste feed rates, boiler water level and pressure, burner operation and pollution control apparatus to allow continuous operation with minimal supervision.

Figure 5:
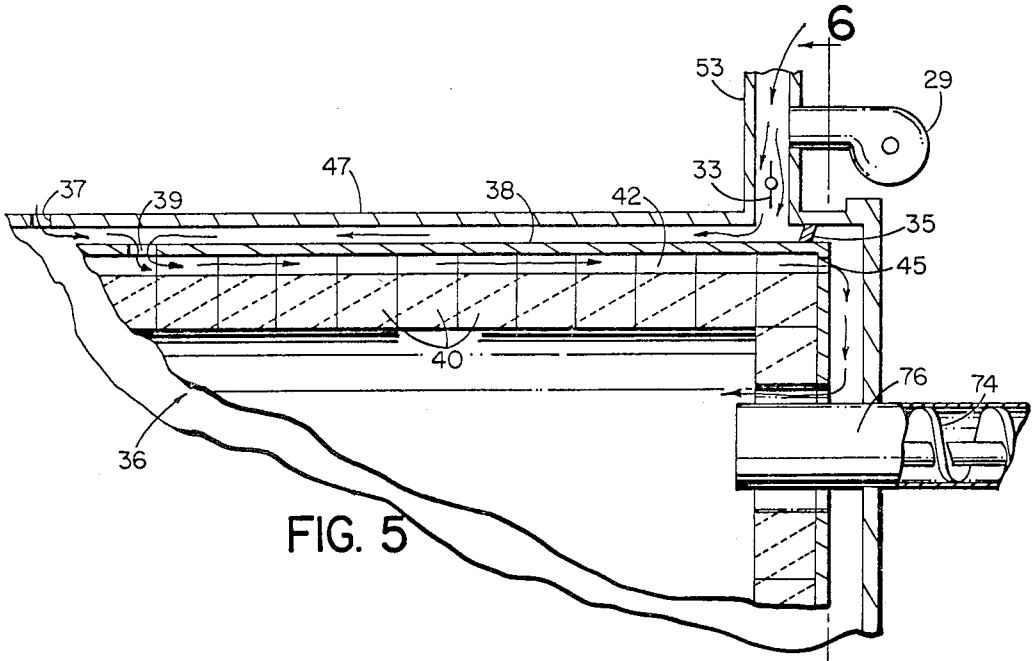
FIG. 5 is similar to FIG. 2 and shows a somewhat enlarged fragmentary sectional view of the incinerator as it appears in FIG. 2.
Figure 6:
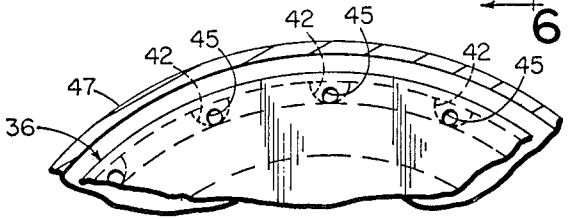
FIG. 6 is a fragmentary sectional view taken along the line 6—6 of FIG. 5.

Considering now the incinerator 12 in further detail, and referring particularly to FIGS. 2–4, the primary oxidation chamber 14 is defined by a cylindrical drum, indicated generally at 36, which is closed at its front end and has a discharge opening 43 at its rear end, as best shown in FIG. 2. The drum 36 has an outer shell 38 formed from sheet metal and lined with refractory material. The illustrated refractory material includes arched firebricks 40, 40 which cooperate with the outer shell to define a plurality of individual passageways 42, 42 between the refractory lining and the outer shell, as best shown in FIGS. 4 and 5. Each passageway 42 communicates with an associated opening 39 in the outer shell 38 near the rear end of the shell and with another associated opening 45 in front end of the outer shell 38, as best shown in FIG. 5. The passageways 42, 42 extend substantially throughout the length of the drum in generally parallel relation to the axis of rotation of the drum, the latter axis being indicated by the numeral 41 in FIG. 2.

The drum 38 is supported for axial rotation by a plurality of rollers 44, 44 journalled on a supporting frame structure and engaged with annular bands which surround the outer periphery of the drum shell 38, as shown in FIG. 1. The drum 36 is preferably supported with its axis of rotation 41 downwardly inclined from the horizontal and in the direction of its open or discharge end. The rollers 44, 44 at opposite sides of the drum are adjustable generally toward and away from each other to permit variation of the angle of inclination of the drum axis 41. A reversible, variable speed drive motor 46, indicated diagrammatically in FIG. 2, is provided for rotating the drum 36 about its axis of rotation, as will be hereinafter further discussed. The primary oxidizing chamber or drum 36 is preferably enclosed within a primary air shroud assembly 47, which includes a front wall 49 and which has a feeder door assembly 51. An annular seal 35 is provided between the front end of the drum 38 and the shroud 47, as best shown in FIG. 5. Air inlet holes, such as the one indicated at 37 in FIG. 5, are or may be provided in the shroud 47 near the discharge end of the drum 36 to admit makeup air into the primary oxidation chamber 14, however, the illustrated incinerator 12 has an air inlet conduit 53 in its shroud near its front end. A blower 29 is or may be provided to deliver air to the conduit 53, as shown in FIG. 5. An adjustable damper or butterfly valve 33 in the conduit 53 may be manually or automatically adjusted to control air flow into the primary combustion chamber 14 through the shroud 47. Air flows into the space between the shroud and the drum, through the openings 39, 39 in the drum shells 38, through the passageways 42, 42 and out through the openings 45, 45 at the front of the drum shell cooling the shroud and drum. The resulting preheated air enters the drum through an opening in its front or infeed end, being drawn into the unit by negative pressure induced by the fan 29.

The secondary oxidation chamber 16 is generally vertically disposed and has a substantially rectangular cross section, as best shown in FIG. 4. It has an outer metal shell, and a liner, preferably formed from retractory material, and includes a rear wall 48, a front wall 50, side walls 52 and 54, and a top wall 56. A circular inlet opening 58 is formed in the front wall 50 and receives an associated portion of the rear or discharge end of the drum 36 therein so that the discharge opening 43 communicates with the secondary oxidation chamber 16. An outlet opening 60 in the side wall 54 at the upper portion of the secondary oxidizing chamber 16 is connected to the stack 28 by an associated outlet duct 61.

In accordance with the present invention, the secondary oxidation chamber 16 includes a plurality of baffle walls, shown in FIG. 2, which extend transversely across the secondary chamber between the side walls 52 and 54. The baffle walls cooperate with the walls of the chamber to define a tortuous flow path for gases of combustion which flow from the primary oxidation chamber 14 into and through the secondary oxidation chamber 16 to and through the outlet opening 60. More specifically, the secondary oxidizing chamber 16 has a first baffle wall 62 which is inclined upwardly and forwardly from a position below the center of the discharge opening 43 and in the direction thereof. The baffle wall 62 terminates at a position above the center of the discharge opening and serves to block flow of gases, ash, inert materials, particulate and other products of combustion from a lower portion of the primary oxidation chamber 14 into the gas stream entering the secondary oxidation chamber 16. Preferably, and as shown, the first baffle wall 62 is upwardly inclined to the horizontal at an angle in the range of 65 to 70 degrees, the latter angle being indicated by the reference numeral 64 in FIG. 2. A second baffle wall 66 extends from the front wall 50 at a position above the discharge opening 43 and is inclined downwardly and in a direction away from the discharge opening 43. Preferably, and as shown, the baffle wall 66 is inclined at an angle of approximately 45 degrees to the vertical, the latter angle being indicated by the reference numeral 68 in FIG. 2. It should be noted that the first and second baffle walls 62 and 66 diverge in a direction away from the discharge opening 43 to define a first venturi region 67, for a purpose which will be hereinafter further discussed.

The illustrated incinerator 10 further includes a third baffle wall 70 inclined downwardly from the rear wall 48 and toward the second baffle wall 66. The third baffle wall 70 terminates at a generally transversely extending front edge spaced from the second baffle wall 66. Preferably, and as shown, the third baffle wall 70 is generally normal to the second baffle wall 66. A fourth baffle wall 72, defined by a lower portion of the rear wall 48, is inclined downwardly and in the direction of the discharge opening 43. The second baffle wall 66 is preferably generally normal to the fourth baffle wall 72 and terminates at a rear edge spaced from the fourth baffle wall. The baffle wall venturis are sized relative to gas flow to create a distribution of the gases over the full width of the secondary oxidation chamber, thus discouraging streaming of gases along paths of least resistance. This arrangement encourages full utilization of the secondary combustion chamber, increases residence time for total combustion capability and results in more efficient combustion per cubic foot with a small volume chamber.

Preferably, at least one of the baffle walls 62, 68 and 70 comprises an assembly of unitary axially elongated ceramic elements loosely associated in adjacent axially parallel side-by-side relation and extending transversely between the side walls of the secondary oxidation chamber. In the illustrated incinerator 12, each of the baffle walls is made from a plurality of axially elongated ceramic tubes 73, 73, packed with high temperature insulating material 71. The ends of the tubes 73, 73 are supported by courses of refractory material which project inwardly from the side walls 52 and 54 to form supporting shelves for the elongated elements. In FIG. 4 the supporting shelves are indicated at 75, 75. Thus, a baffle wall is readily formed by resting the elements 73, 73 on the shelves 75, 75 and adjacent each other. Alternatively, one or more of the baffle walls may be formed from a plurality of axially elongated solid ceramic rods 73*a*, 73*a*. A typical rod 73*a* is shown in FIGS. 7 and 8.

A slotted ceramic air header 74 extends transversely of the secondary oxidation chamber 16 along the rear edge of the second baffle wall 66, as will be hereinafter further discussed. A plurality of wide angle view sight glasses are or may be provided in the walls of the secondary oxidation chamber 16 to permit observation of conditions within the chamber. A safety explosion cap may also be provided for venting gas from the chamber 16 in the event of an excessive pressure build-up with the chamber, however, for clarity of illustration the sight glasses and safety explosion cap are not shown.

The illustrated feeding apparatus 22 comprises an auger/shredder which includes an auger 74 supported for rotation within a compaction tube 76 and a loading hopper 78 for supplying waste material to the auger. The auger 74 is driven by a variable speed drive motor 80, diagramatically illustrated in FIG. 2.

The ash receiver 20 is disposed generally below the secondary combustion chamber 16 to receive ash and other unburned material from both the primary and the secondary combustion chambers. The ash receiver has inner and outer walls and baffles (not shown) disposed between the latter walls which cooperate with the walls to define a tortuous ash cooling passageway 82 therebetween, as shown somewhat schematically in FIG. 2. A conduit 84 communicates with the cooling passageway 82 and with the secondary combustion chamber 16 for a purpose which will be hereinafter further discussed. An air impeller or blower (not shown) may be provided for moving air within the cooling passageway 82 and the conduit 84. Unburned residue from the ash receiver is deposited continuously on a shaker hearth or other movement device such as the illustrated conveyor belt 86 which may be of a solid plate-type and which is shrouded against uncontrolled air introduction. The conveyor belt 86 carries this ash and inert unburned material away from the base of the secondary oxidation chamber and deposits it in a waiting container (not shown) located below a pair of hopper doors 85.

Preparatory to operating the incineration system 12 the burners 18 and 24 are operated to bring the primary and secondary oxidation chambers up to predetermined temperatures. Temperature sensing devices 88 and 90 which comprise part of the control system 33 are disposed within the first and second oxidation chambers 14 and 16 for monitoring temperatures and/or rates of temperature change therein. Solid or semi-solid waste materials and/or sludges are loaded into the hopper 78. Another sensing device 92 which forms part of the control system 33 and which may, for example, comprise a photoelectric cell, is arranged to detect the presence of a predetermined quantity of waste material in the hopper 78. When the temperature sensing devices 88 and 90 in the first and second oxidation chambers indicate that the temperatures therein have reached predetermined levels and the sensing device 92 associated with the hopper 78 indicates that the waste material therein equals or exceeds a predetermined quantity, the auger drive motor 80 is automatically activated by the controller 34 initiating the feeding cycle.

The incinerator 12 operates most efficiently when the wastes being fed into it are uniformly sized and of uniform density. Solid waste materials as found in industrial and municipal waste stream are seldom uniformly sized and in fact vary widely in their density, size, and BTU content characteristics, for example, low heating value wet materials such as garbage together with relatively dense materials like paper catalog and computer run offs are often mixed with high heat value plastics, wooden construction materials, light and compressible waste basket trash and a variety of noncombustibles. The auger/shredder 22 solves these problems.

The rotating auger 74 captures waste material supplied to it by the hopper 78 and forces the material into the compaction tube 76, while breaking, shredding and crushing it, thereby reducing it to somewhat uniform size and density. A fairly dense sausage-like plug of waste material results, which is fed into the primary oxidation chamber 14 while reducing if not substantially wholly eliminating entry of air through the compaction tube 76. Thus, mechanical doors or other sealing devices are not required at the entry end of the incinerator. The sensing devices hereinbefore described which comprise the control system 33 automatically shutdown the auger/shredder 22 if material within the hopper falls below a predetermined level or if the temperature within either the primary oxidation chamber 14 or the secondary oxidation chamber 16 drops below a predetermined level. The ignition burner 18, mounted on the stationary wall 49, is slightly offset and directed toward the hearth for efficient waste material ignition and to provide for the effective introduction or additional heat as may be required to sustain combustion. Materials which are self-sustaining during combustion (for example, materials having a BTU value greater than 3000 BTU per pound and with a moisture content less than 30 percent) will not normally require additional heat from an external source after startup.

When the temperature within the primary oxidation chamber 14 reaches a predetermined high level the temperature sensing device 88 within the latter chamber signals shutdown of the burner 18. In like manner the burner 24 responds to the temperature sensor 90 within the secondary oxidation chamber 16 and is shutdown when the temperature within the latter chamber reaches a predetermined high level. Alternatively, burner operational cycle time may be controlled by one or more integral timers associated with the controller 34. Depending upon the materials being burned, combustion within the primary oxidation chamber 14 can be controlled from a partially pyrolytic condition to an oxidating one.

As previously noted, negative pressure is normally maintained in the primary oxidation chamber by draft induced within the system. However, the butterfly valve 33 may be adjusted to control the flow of air into the primary oxidation chamber from the conduit 53 whereby to aid in maintenance of negative pressure within the primary oxidation chamber. Additional controls may be provided to assure maintenance of the desired negative pressure. Thus, for example, appropriate controls may be provided which respond to a pressure sensing device, such as indicated at 97 in FIG. 2, located within the primary oxidation chamber 14, to control the butterfly valve 33, which controls the supply of air to the primary oxidation chamber and/or the induced draft, as may be necessary to maintain the desired negative pressure within the primary chamber.

The angle of drum inclination is adjusted to assure proper advance of waste material through the drum 38. The rate of drum rotation, which may be proportionally controlled and which determines retention time of waste material within the primary combustion chamber 14, is controlled by the drive motor 46. The drive motor 46 normally rotates the drum 38 in one direction, however, the direction of drum rotation may be reversed, if necessary, to clear a jam within the primary oxidation chamber. The rotary action of the drum 38 continuously exposes new surfaces of burning waste to the hot hearth and air as the burning waste travels down the incline toward the discharge opening 43. This constant agitation and the ability to control retention time within the primary combustion chamber 14 provides for efficient combustion. Ash and other noncombustible residue is conveyed to and through the discharge end of the drum 38 by the combined action of drum rotation and incline and fall into the ash receiver 20. The first baffle wall 62 effectively blocks the lower portion of the discharge opening 43 and prevents the unburned residue from entering the secondary oxidizing chamber.

The volatile products of combustion leave the primary oxidation chamber 14 through the upper portion of the discharge opening 43 and enter the secondary oxidation chamber 16 through a first venturi region defined by the upper portions of the downwardly diverging first and second baffle walls 62 and 66 and indicated by the numeral 67. The controlled partial pyrolisis in the primary oxidation chamber provides uncombusted gases which when combined with air emitted from the burner or burners in the secondary combustion chamber 16, such as the burner 24, assure maintenance of oxidizing temperatures, normally in the 1800 degree F. to 2400 degree F. range.

As the volatile gases enter the secondary oxidation chamber 16 through the first venturi region 67, the velocity of the moving gas stream, increases. Additional air is or may be added to the gas stream in the first venturi region 67, and for this reason the preheated air from the ash receiver cooling system is introduced into the secondary combustion chamber in the first venturi region 67 through the conduit 84.

Ash and other particulate material entrained in the gas which flows in a path along the second baffle wall 66 tend to impringe upon the fourth baffle wall 72. Separation of the ash and particulate material from the gas ocurs at the point of impact allowing fallout material to travel downwardly along the inclined fourth baffle wall 70 and into the ash container 20 therebelow.

The velocity of the gases decrease as the gases flow downwardly and away from the first venturi region 67 toward the ash container 20 which results in further fallout of particulate material entrained within the gas stream.

As the hot gases flow upwardly past the forward end of the second baffle wall 66 and in the direction of the third baffle wall 70, air introduced through the slotted ceramic air header 74 mixes with the gases. The slots in the header 74 direct streams of air into the gas flow stream. The arrangement of the second and third baffle walls 66 and 70 and the air header 74 tend to induce a vortex in the region below the third baffle wall 70. The swirling gases in this region impinge upon the baffle walls 66 and 70 and associated walls of the secondary oxidation chamber causing further impact separation.

As the hot gases flow past the lower edge of the third baffle wall 70 and into the upper portion of the secondary oxidation chamber 16, a second vortex is induced within the upper portion of the chamber 16 by the particular arrangement of the baffle walls 66 and 70 and the associated walls of the chamber. The spinning action of the gases induced by the shape of the various regions defined by the walls of the secondary oxidation chamber and the baffles positioned therein causes centrifugal separation of particulate matter and assures thorough mixing of air and gases for efficient combustion. This cyclonic and impact separation within the secondary oxidation chamber or afterburner permits achievement of high efficiency, because of the low density and extremely high temperature of the gases within the afterburner. The tortuous path of the gases through the secondary combustion chamber increases retention time for further operational efficiency.

In the illustrated system 10 the hot gases from the secondary oxidation chamber 16 flow through the duct 61 and the stack 28 and into the heat recovery boiler 26. The illustrated boiler is a three-pass, horizontal, firetube package boiler designed to operate at pressures up to 150 PSI, however, heat exchangers of other kinds may also be used to recover heat from the hot gases generated by the incineration system 10.

In the illustrated system the gases are ducted from the boiler 26 into the baghouse 30. Particles entrained in the gas stream enter the lower section of the baghouse and pass through filter tubes (not shown). Particulate materials are retained on the outer surface of these tubes. Cleaned gases leave the baghouse through associated exhaust duct and flow into the base of the scrubber 30, wherein noxious gases such as chlorine, hydrogen chloride, and hydrogen sulfide, for example, are removed from the exhaust stream by a gas absorption process, well known in the art. After the moist gases have passed through a demister section of the scrubber, where final traces of moisture are removed, the dry gases leave the scrubber and are ducted to the exhaust fan 28 and exhausted to atmosphere. However, the incinerator unit, hereinbefore described, is expected to produce such high burning efficiency and low particulate carry-over that no baghouse or other particulate filter device will be required for the majority of waste material processed. It is expected that the illustrated incineration unit will meet current federal environmental requirements of 0.08 grains per dry standard cubic foot of gas correlated to 12 percent $CO_2$ when processing waste materials of classification types 0, 1, 2, 3 and 4.

The rate at which the combustable waste material is fed into the drum 36 and the rate at which the material is advanced through the drum to its discharge end is preferably controlled in response to trends within the system, or more specifically, within the primary and secondary oxidation chambers. Thus, for example, if the temperature within the incinerator 10 is rising the control system will respond to reduce the feed rate of the auger/shredder 22 and/or reduce the rate of rotation the drum 38. By stopping the drum 38 or reducing its rate of rotation the unburned materials in the drum are quieted so that a layer of ash forms on the material to insulate it against oxygen and heat. Conversely, if the temperature within the incinerator 12 is declining the sensors 88 and 90 associated within the control system may respond by altering the rate of waste feed and/or drum rotation and/or by operating one or both of the burners 18 and 24, as may be necessary to achieve balance within the system. Further control is or may be achieved by the utilization of an oxygen or gas analyzing device, such as indicated at 94 for monitoring the gases leaving the secondary combustion chamber 16. This gas monitoring device may, for example, be arranged to control introduction of makup air into either or both combustion chambers, so that additional air will be introduced when an oxygen deficiency is indicated or the air supply reduced when excess oxygen is present. Further refinement of the control system is achieved by utilization of a computer 96 for analyzing trends, averaging results, and sequencing equipment operation. The computer 96 may be coordinated with sensor selection, modified by programmed data based upon known characteristics of the material being processed as, for example, its BTU value per pound, density and moisture content. Thus, the incinerator system 12 may be controlled to provide substantially uniform operational characteristics and high efficiency despite widely varying characteristics of the waste material processed.

Figure 11:
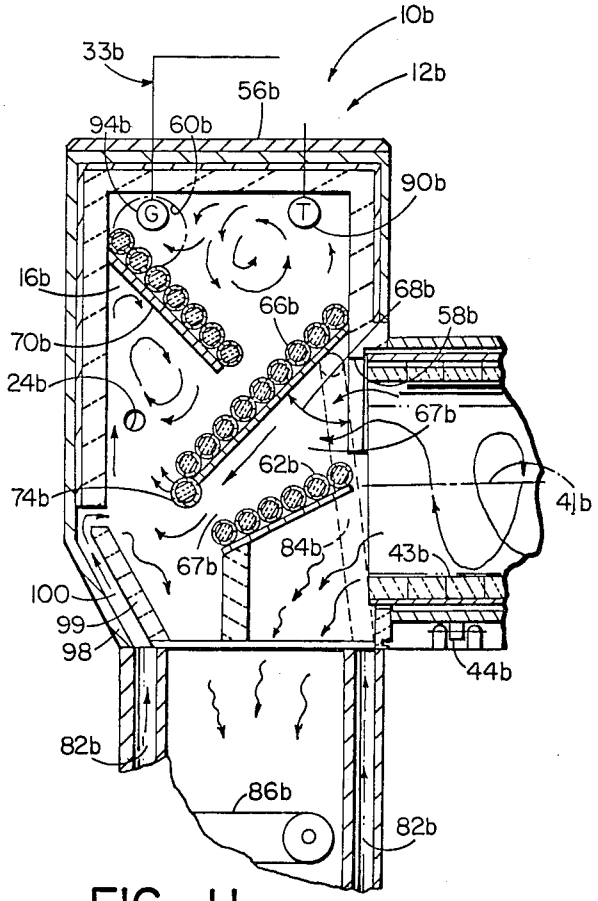
FIG. 11 is a fragmentary sectional view similar to FIG. 2, but shows another incinerator.

In FIG. 11 there is shown a portion of another incinerator system indicated generally at **10*b*. The system 10*b* is similar in many respects to the system 10**, previously described, and each part similar or substantially identical to a part previously described bear the same reference numeral as the corresponding previously described part and a letter "b" suffix and will not be hereinafter further described.

The illustrated system **10*b* includes an incinerator indicated generally at 12*b* which has a rotary primary oxidation chamber 14*b* and a stationary vertical secondary oxidation chamber 16*b*. The incinerator 12*b* differs from the previously discussed incinerator 12 in the construction and arrangement of the wall of the secondary oxidation chamber 16 and in the arrangement of the baffle wall 62*a* located within the latter chamber. Specifically, the secondary chamber 16*b* has a metal outer shell or exterior wall 98 and a liner or interior wall 99 made from refractory material. A passageway 100 is defined between the exterior wall 98 and the interior wall 99 at the rear of the secondary oxidation chamber housing and communicates with an ash cooling passageway 82*b* and with the secondary oxidation chamber 16*b* to supply preheated air to the latter oxidation chamber. Another passageway 84*b* is formed between the exterior wall 98 and the interior wall 99 in at least one of the sidewalls of the secondary oxidation chamber housing and communicates with the ash cooling passageway 82*b* and the secondary oxidation chamber 16*b* near the upper part of the discharge opening 43*b*, substantially as shown in FIG. 11**.

The baffle wall **62*b* has a lower portion which is generally vertically disposed and extends upwardly from a position below the discharge opening 43*b*. The baffle wall 62*b* further includes an upper portion which is joined to the lower portion at a position below the center of the drum discharge opening 43*b* and which extends upwardly and in the direction of the discharge opening to a position above the center of the discharge opening. The first baffle wall and the second baffle wall converge in a direction away from the discharge opening 43*b* and define a first venturi region 67*b* therebetween. Air emitted from the passageway 100 enters the gas stream from the first venturi region 67*b*, substantially as shown in FIG. 11**.

We claim:

1. An incineration system comprising an incinerator unit including a rotary drum having a discharge opening at one end and defining a generally horizontally extending primary oxidation chamber, means defining a generally vertically extending secondary oxidation chamber and having an outlet opening in its upper portion and an inlet opening in its lower portion, said discharge opening communicating with said inlet opening, and baffle means disposed within said secondary oxidation chamber and including a first baffle wall inclined upwardly from a position below the center of said discharge opening and in the direction of said discharge opening for blocking flow of gases and other products of combustion from a lower portion of said primary oxidation into said secondary oxidation chamber, and a second baffle wall inclined downwardly from a position above said discharge opening and in a direction away from said discharge opening, said baffle walls cooperating with each other and with the walls of said secondary oxidation chamber to define a tortuous flow path for gases of combustion flowing from said primary oxidation chamber through said discharge opening and said inlet opening into and through said secondary oxidation chamber to said outlet opening.

2. An incineration system as set forth in claim 1 wherein said baffle means includes a third baffle wall inclined downwardly and toward said second baffle wall and terminating in spaced relation to said second baffle wall.

3. An incineration system as set forth in claim 2 wherein said baffle means includes a fourth baffle wall inclined downwardly and in the direction of said discharge opening and said second baffle wall extends toward said fourth baffle wall and terminates in spaced relation to said fourth baffle wall.

4. An incineration system as set forth in claim 3 wherein said fourth baffle wall comprises said means defining said secondary oxidation chamber.

5. An incineration system as set forth in any one of claims 1 through 4 wherein said first and second baffle walls diverge in a direction away from said discharge opening.

6. An incineration system as set forth in any one of claims 1 through 4 wherein said third baffle wall is generally normal to said second baffle wall.

7. An incineration system as set forth in claim 6 wherein said second baffle wall is inclined approximately forty-five degrees to the vertical axis of said secondary oxidation chamber.

8. An incineration system as set forth in claim 7 wherein said first baffle wall is upwardly inclined at an angle in the range of sixty-five to seventy degrees.

9. An incineration system as set forth in claim 8 wherein said second baffle wall is generally normal to said fourth baffle wall.

10. An incineration system as set forth in claim 1 wherein at least one of said baffle walls comprises an assembly of unitary axially elongated refractory elements arranged in loosely associated axially parallel side-by-side relation to each other, each of said elements being supported only at its opposite ends and retained in assembly with the other of said elements by the force of gravity.

11. An incineration system as set forth in claim 10 wherein said refractory elements comprise ceramic tubes.

12. An incineration system as set forth in claim 11 wherein each of said tubes has insulating material packed therein.

13. An incineration system as set forth in claim 10 wherein said refractory elements comprise solid rods.

14. An incineration system as set forth in claim 1 including means supporting said drum for rotation about a horizontally inclined axis of rotation.

15. An incineration system as set forth in claim 14 including means for adjusting the angle of inclination of said axis of rotation.

16. An incineration system as set forth in claim 1 wherein said system includes ash receiving means for receiving ash from at least one of the oxidation chambers, means for defining a cooling passageway in heat exchange relationship to said ash receiving means, means for circulating air within said cooling passageway to cool said ash and heat said air, and means for introducing said air into said incinerator after said air has been heated by said ash receiving means.

17. An incineration system as set forth in claim 1 including feeding means for supplying combustible material to said primary oxidation chamber and control means responsive to at least one condition within at least one of said chambers including said primary combustion chamber and said secondary oxidation chamber for controlling operation of said feeding means.

18. An incineration system as set forth in claim 17 wherein said feeding means comprises an auger/shredder.

19. An incineration system as set forth in claim 17 or claim 18 wherein said control means comprises temperature responsive means for regulating the rate of operation of said feeding means.

20. An incineration system as set forth in claim 17 or claim 18 wherein said temperature responsive means is responsive to a rate of temperature change within said one chamber.

21. An incineration system as set forth in claim 1 including drum drive means for rotating said drum and control means responsive to at least one condition within at least one of said chambers including said primary oxidation chamber and said secondary oxidation chamber for controlling the operation of said drum drive means.

22. An incineration system as set forth in claim 21 wherein said control means comprises temperature responsive means for regulating the rate of rotation of said drum.

23. An incineration system as set forth in claim 21 or claim 22 wherein said control means comprises means responsive to the rate of temperature change within said one chamber.

24. An incineration system as set forth in claim 1 wherein said incinerator includes drive means for rotating said drum, feeding means for supplying combustible material to said primary oxidation chamber, and a control system having control means responsive to at least one condition in at least one of the chambers including said primary oxidation chamber and said secondary oxidation chamber to control operation of either and both said drum drive means and said feeding means.

25. An incineration system as set forth in claim 24 wherein said one condition comprises a rate of temperature change within said one chamber.

26. An incineration system as set forth in claim 25 wherein said one chamber comprises said secondary oxidation chamber.

27. An incineration system as set forth in any one of claims 24 through 26 wherein said control system includes computer means responsive to changes in conditions within said incinerator system for modifying the operation of said control means.

28. An incineration system as set forth in any one of claims 24 through 26 wherein said control system includes programmable computer means responsive to programmed data relating to characteristics of material being processed in said incinerator for modifying operation of said control means.

29. An incineration system as set forth in claim 1 including means for introducing air into at least one of the chambers including said primary oxidation chamber and said secondary oxidation chamber, gas sensing means within said incineration system, and means responsive to said gas sensing means for controlling said air introducing means.

30. An incineration system as set forth in claim 1 wherein said first baffle wall is inclined upwardly from a position below said discharge opening.

31. An incineration system as set forth in claim 1 wherein said first baffle wall has a first portion extending vertically upward from a position below said discharge opening and a second portion inclined upwardly from said first portion and in the direction of said discharge opening.

32. An incineration system as set forth in any one of claims 1, 30 and 31 wherein said first baffle wall terminates at a position above the center of said discharge opening.

33. An incineration system as set forth in any one of claims 1 through 4 wherein said first and second baffle walls converge in a direction away from said discharge opening.

34. An incinerator comprising a rotary drum defining a primary oxidation chamber and having a discharge opening at one end, means defining a secondary oxidation chamber having an inlet opening and an outlet opening, said discharge opening communicating with said inlet opening, baffle means disposed within said secondary oxidation chamber for defining a tortuous flow path for gases of combustion flowing from said primary oxidation chamber into and through said secondary oxidation chamber to said outlet opening, ash receiving means for receiving ash from at least one of the oxidation chambers, means defining an ash cooling passageway in heat exchange relationship to said ash receiving means, means for circulating air within said ash cooling passageway to cool said ash and heat said air, and means for introducing said air into said incinerator after said air has been heated by said ash receiving means.

35. An incinerator as set forth in claim 34 wherein said means for introducing said heated air is further characterized as means for introducing said heated air into one of the oxidation chambers which include said primary oxidation chamber and said secondary oxidation chamber.

36. An incinerator as set forth in claim 35 wherein said one chamber comprises said secondary oxidation chamber.

37. An incinerator as set forth in claim 34 wherein said baffle means defines a first venturi region within said secondary oxidation chamber and said heated air is introduced within said first venturi region.

38. An incinerator as set forth in any one of claims 34 through 35 wherein said ash receiving means has inner and outer walls and said ash cooling passageway is disposed between said inner and outer walls.

39. An incinerator as set forth in claim 34 wherein said secondary oxidation chamber has an interior wall and an exterior wall defining another cooling passageway therebetween and said other cooling passageway comprises said means for introducing air into said incinerator.

40. In an incinerator having an oxidation chamber including an outlet opening, and baffle means disposed within said oxidation chamber for defining a tortuous flow path for gases of combustion flowing from said oxidation chamber through said outlet opening and including at least one baffle wall, the improvement wherein said one baffle wall comprises an assembly of unitary axially elongated refractory elements loosely associated in adjacent axially parallel side-by-side relationship, each of said elements being supported only at its opposite ends and maintained in assembly with the other of said elements by the force of gravity.

41. In an incinerator as set forth in claim 40 the further improvement wherein each of said elements comprises a ceramic tube.

42. In an incinerator as set forth in claim 41 the further improvement wherein said tube is packed with insulating material.

43. In an incinerator as set forth in claim 42 the further improvement wherein each of said elements comprises a solid rod.

44. In an incinerator as set forth in any one of claims 40 through 43 wherein said opposite ends are supported on shelves projecting from opposing walls of said oxidation chamber.

45. An incinerator comprising a rotary drum defining a primary oxidation chamber having a discharge opening at one end, means defining a secondary oxidation chamber having an inlet opening and an outlet opening, said discharge opening communicating with said inlet opening, baffle means disposed within said secondary oxidation chamber for defining a tortuous flow path for gases of combustion flowing from said primary oxidation chamber into and through said secondary oxidation chamber to said outlet opening, drum drive means for rotating said drum, feeding means for supplying combustible material to said primary oxidation chamber, and control means responsive to the rate of temperature change in at least one of the chambers including said primary oxidation chamber and said secondary oxidation chamber to control the operation of either and both said drum drive means and said feeding means.

46. An incinerator as set forth in claim 45 wherein said one chamber comprises said secondary oxidation chamber.

47. An incinerator as set forth in claim 45 or claim 46 wherein said control means includes programmable computer means responsive to programmed data relating to characteristics of material being processed in said incinerator for modifying operation of said control means.

48. An incinerator comprising a rotary drum defining a primary oxidation chamber having a discharge opening at one end, means for supplying air to said primary oxidation chamber, means for regulating the quantity of air delivered by said supply means to said primary oxidation chamber, means defining a secondary oxidation chamber having an inlet opening and an outlet opening, said discharge opening communicating with said inlet opening, baffle means disposed within said secondary oxidation chamber for defining a tortuous flow path for gases of combustion flowing from said primary oxidation chamber into and through said secondary oxidation chamber to said outlet opening, drum drive means for rotating said drum, pressure sensing means disposed within said primary oxidation chamber for detecting the pressure within said primary oxidation chamber and control means responsive to said pressure sensing means to control operation of either and both said drum drive means and said regulating means to maintain a predetermined pressure condition within said primary oxidation chamber.

49. An incineration system for burning refuse, trash and industrial wastes and comprising an incinerator unit including a rotary drum having a discharge opening at one end and defining a generally horizontally extending primary oxidation chamber, means defining a generally vertically extending secondary oxidation chamber and having an outlet opening in its upper portion and an inlet opening in its lower portion, said discharge opening communicating with said inlet opening, and baffle means disposed within said secondary oxidation chamber for blocking flow of gases and other products of combustion from a lower portion of said primary oxidation into said secondary oxidation chamber and cooperating with each other and with the walls of said secondary oxidation chamber to define a tortuous flow path for gases of combustion flowing from said primary oxidation chamber through said discharge opening and said inlet opening into and through said secondary oxidation chamber to said outlet opening, means for continuously sizing, compacting and feeding refuse, trash and industrial wastes into said primary oxidation chamber including an auger shredder having a compaction tube disposed in sealed relation to the inlet end of said primary oxidation chamber, a rotary shredding and compacting auger suported to rotate within said auger shredder, a shear plate, a gravity fed hopper for continuously supplying refuse, trash and industrial wastes to said compaction tube, and a drive motor for rotating said auger, and control means responsive to at least one condition within at least one of the chambers including said first and second oxidation chambers for controlling said drive motor to regulate the rate of operation of said sizing, compacting and feeding means.

* * * * *